US006050534A

United States Patent [19]

Andrews

[11] Patent Number: 6,050,534

[45] Date of Patent: Apr. 18, 2000

[54] CUBICLE CURTAIN AND IV TRACK SUPPORT AND MOUNTING CLIP

[76] Inventor: Carl E. Andrews, 10210 Tenbrook Dr., Silver Spring, Md. 20901

[21] Appl. No.: 09/008,561

[22] Filed: Jan. 16, 1998

[51] Int. Cl.[7] ..... A47H 1/10; B42F 13/00; E04B 2/00

[52] U.S. Cl. ..... 248/317; 248/343; 52/506.07

[58] Field of Search ..... 248/343, 300, 248/317, 298.1; 52/484

[56] References Cited

U.S. PATENT DOCUMENTS

| | | | |
|---|---|---|---|
| 3,275,817 | 9/1966 | Schwartz et al. | 240/9 |
| 3,599,921 | 8/1971 | Cumber | 248/317 |
| 3,612,461 | 10/1971 | Brown | 248/317 |
| 3,843,086 | 10/1974 | Ptak | 248/317 |
| 3,861,105 | 1/1975 | Starks | 52/484 |
| 5,077,951 | 1/1992 | Baker | 52/484 |

*Primary Examiner*—Anita M. King
*Assistant Examiner*—Michael Nornberg
*Attorney, Agent, or Firm*—Jacobson, Price, Holman & Stern, PLLC

[57] ABSTRACT

A suspended clip for mounting and supporting cubicle curtain and IV tracks below a standard suspended tee bar and acoustical lay in tiles ceiling system. The suspended clips are independent of the ceiling system and configured to allow easy connection to the cubicle curtain and IV tracks, as well as to allow ceiling tiles removal without disassembling any tracks. The invention relates to a device for attachment of cubicle curtain and IV tracks in intensive care units, recovery rooms, treatment rooms and similar premises where above ceiling equipment monitoring and maintenance is required. The device also provides for patient safety in the context of being designed to transfer the carrying load to the main structure above by means of hanger wires. The hanger wires are adequately sized and securely fastened to the underside of the structure above.

10 Claims, 11 Drawing Sheets

CUBICLE CURTAIN AND IV TRACK SUPPORT AND MOUNTING CLIP

BACKGROUND OF THE INVENTION

The invention relates to a device for attachment of cubicle curtain and IV tracks in intensive care units, recovery rooms, treatment rooms and similar premises where above ceiling equipment monitoring and maintenance is required. The device also provides for patient safety in the context of being designed to transfer the carrying load to the main structure above by means of hanger wires. The hanger wires are adequately sized and securely fastened to an underside of the structure above.

BRIEF SUMMARY OF THE INVENTION

A suspended clip for mounting and supporting cubicle curtain and IV tracks below a standard suspended tee bar and acoustical lay in tiles ceiling system.

Unlike other systems that are supported by and partly connected to the ceiling system, the suspended clips are independent of the ceiling system and configured to allow easy connection to the cubicle curtain and IV tracks, as well as to allow ceiling tiles removal without disassembling any tracks.

DETAILED DESCRIPTION OF THE INVENTION

Figure 1:
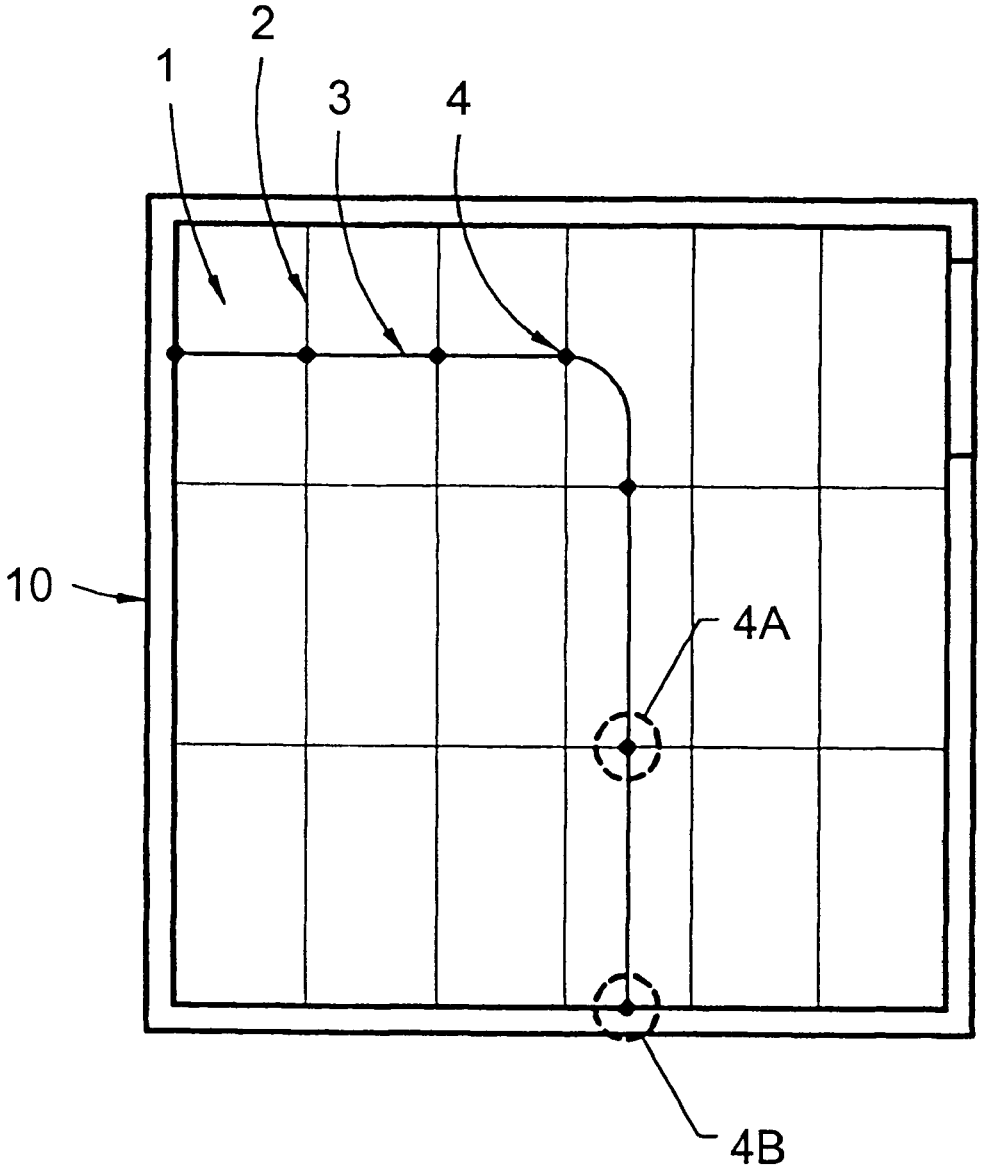
FIG. 1: Plan view of a typical curtain track configuration in relation to ceiling grid and support clip location.

FIG. 1 illustrates a typical ceiling layout consisting of ceiling tiles 1 and ceiling tee bar grid system 2. A typical cubical curtain track configuration 3 is shown running through the grid, and 4 is a typical support clip location. 4A is cross-referenced to FIG. 2 illustration of an enlarged plan detail of the support clip over the tee bar. 4B is cross-referenced to FIG. 5 enlarged section detail of a modified end version of the support clip, designed to provide support where the track terminates at a wall.

Figure 2:
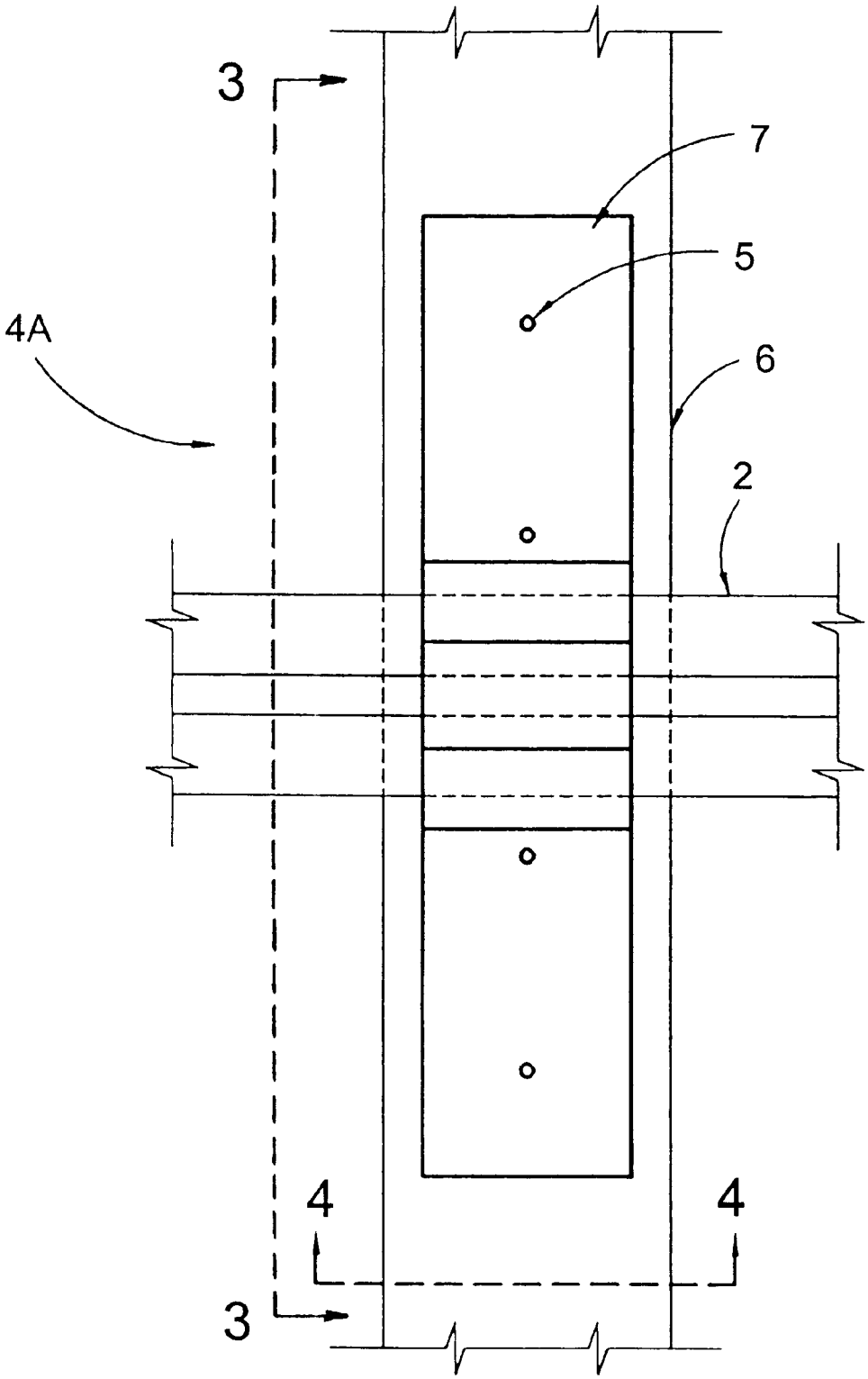
FIG. 2: Enlarged plan view of the standard version support clip shown in relation to the tee bar and curtain or IV track.

Enlarged plan detail FIG. 2 illustrates support clip 7 over tee bar 2. Pre-drilled holes 5 are sized and spaced to provide for fastening the support clips to the cubicle curtain of IV tracks 6. Section 3—3 and 4—4 are cut to show the support clip configuration and placement in relation to the tee bar, and attachment of the cubicle curtain or IV track to the clip.

Figure 3:
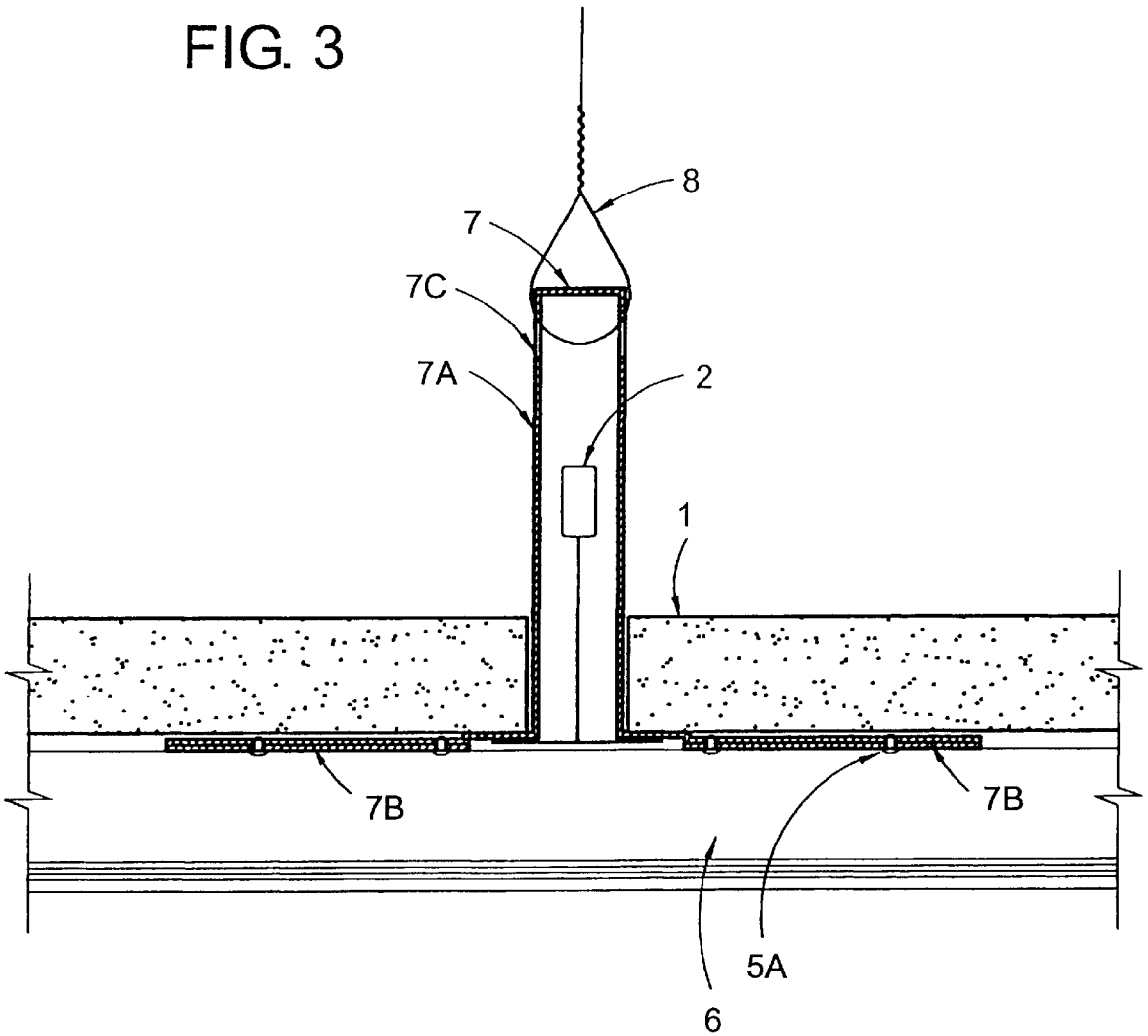
FIG. 3: Section cut through the ceiling system showing the connection of the standard version support clip to the curtain or IV track as well as its relation to the tee bar, hanger wire and ceiling tiles.

FIG. 3, an illustration of cross-section 3—3 from FIG. 2, is an enlarged detail showing support clip standard version 7 which is fabricated from a single piece of material and molded in the shape of a hat channel. The vertical sides of the channel 7A has a pre-drilled hole 7C at the upper end of each side to allow the hanger wire to be treated and tied to the support clip. The horizontal flanges 7B of the channel are turned back under itself to provide added support and greater thickness to accept fastening.

The support clip standard version 7 is positioned with its horizontal flanges perpendicular to the tee bar when viewed in cross-section. The clip is tied to and supported by hanger wire 8 which is securely fastened to the underside of the structure above.

Track 6 is positioned with its top directly up against the underside of the support clip's horizontal flanges 7B. The longitudinal direction of the track runs in line with the support clip's horizontal flanges and perpendicular to the tee bar. The clip and track are connected by mechanical fastener 5A. Pre-drilled holes are provided on the horizontal flanges of each clip to accommodate the connection to the track.

Figure 4:
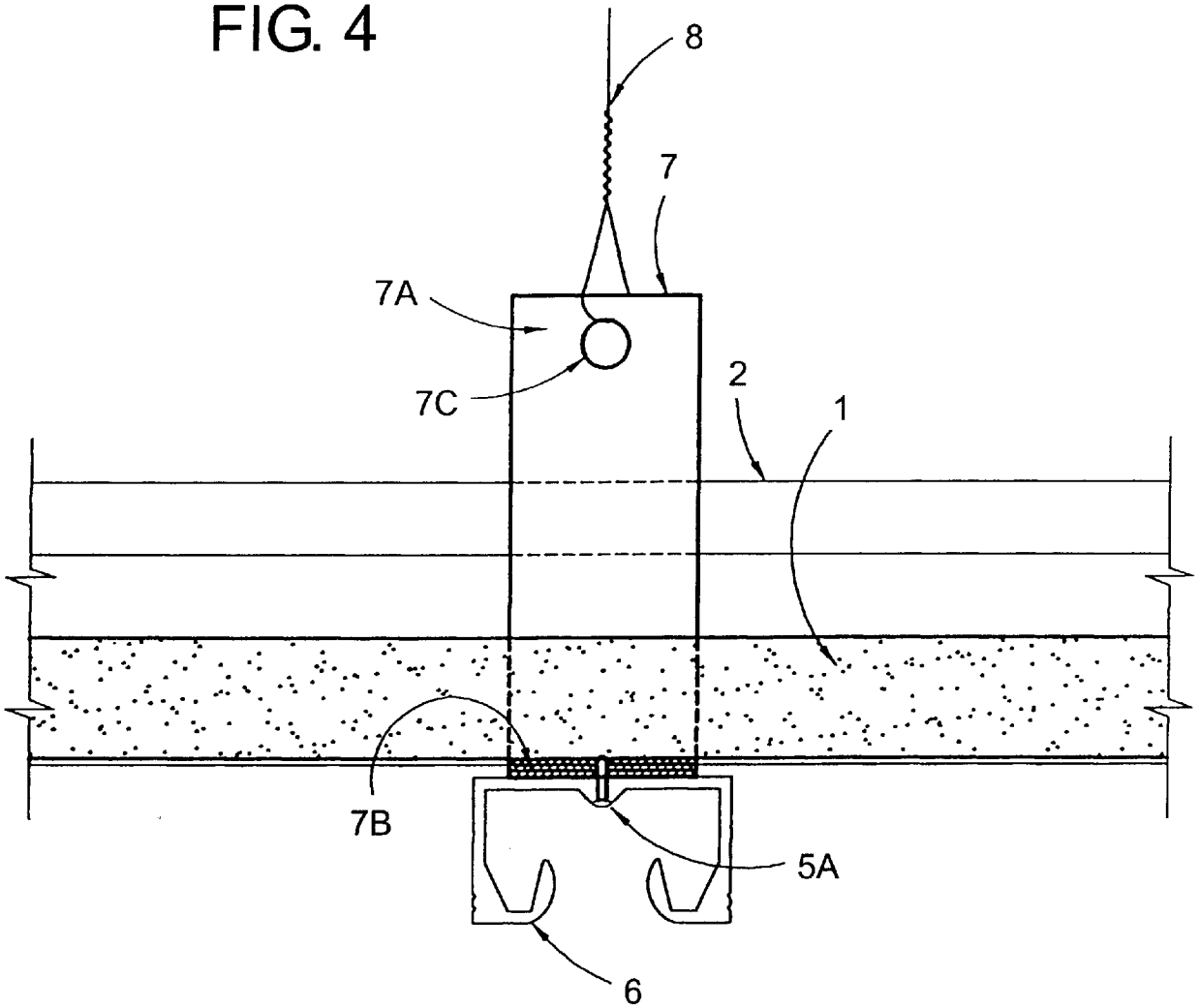
FIG. 4: Section cut through the ceiling system showing the connection of the standard version support clip to the curtain or IV track as well as its relation to the tee bar, hanger wire and ceiling tiles.

FIG. 4 is the same track connected to the standard version support clip over tee-bar configuration viewed from another angle as cross-referenced to section 4—4, FIG. 2.

Figure 5:
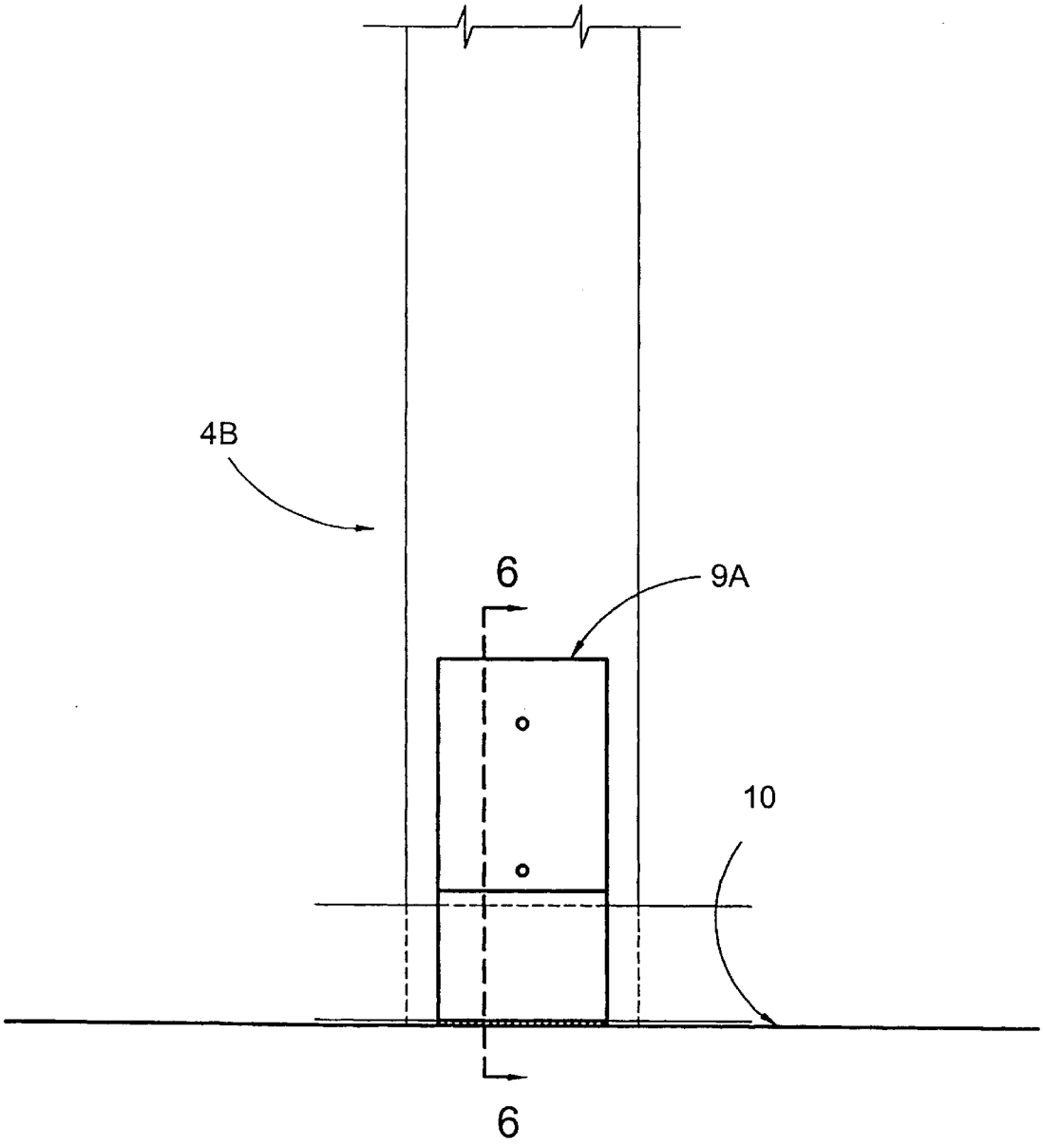
FIG. 5: Enlarged front view of the modified end version support clip.
Figure 6:
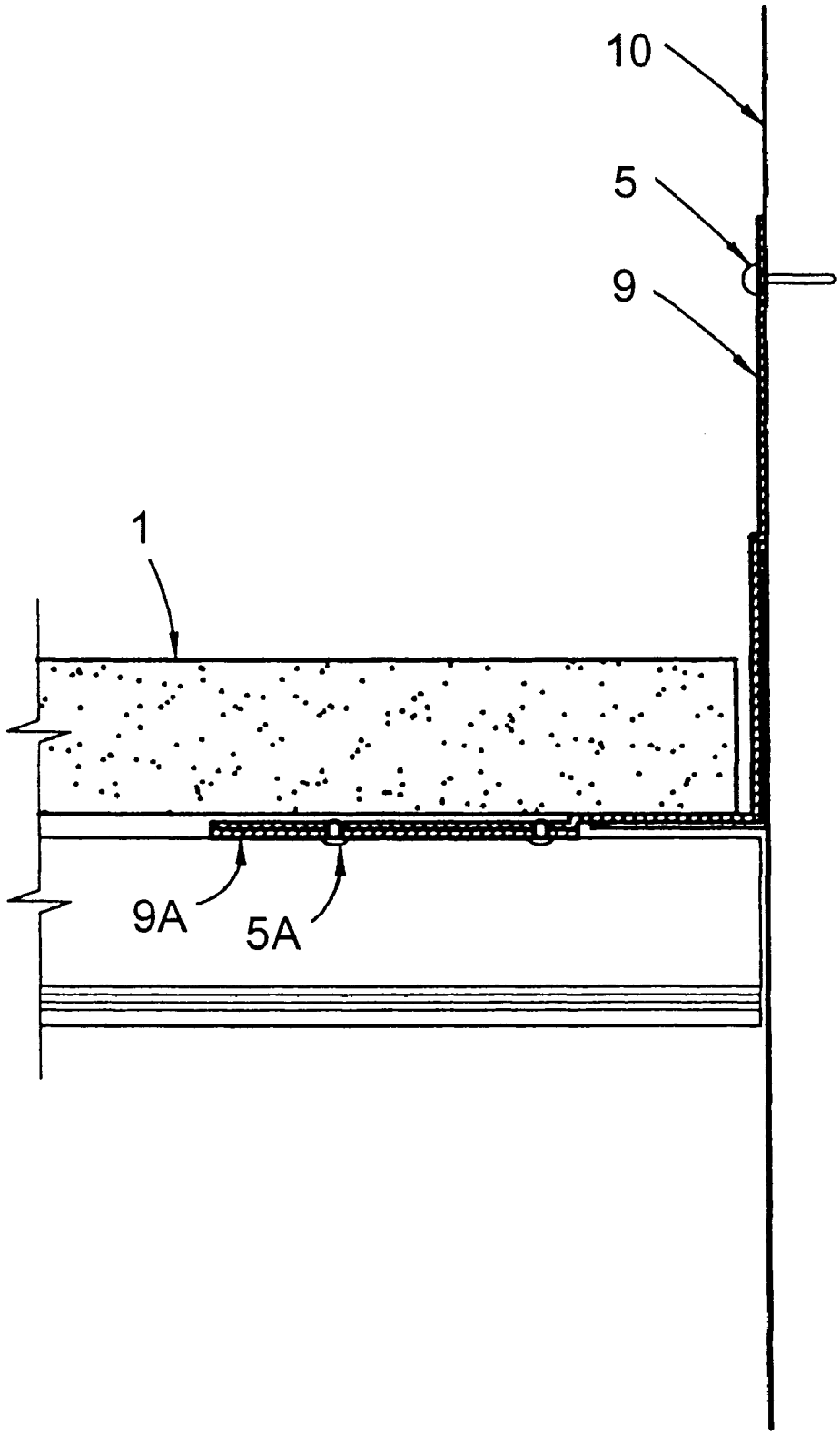
FIG. 6: Section cut through the ceiling system showing the modified end version support clip connection to a wall.

FIG. 5 and FIG. 6 illustrate the modified end version support clip, designed to provide support where the end of a track terminates at wall 10. The modified clip is configured in the shape of an angle with a vertical stem 9 and a horizontal flange 9A. The upper part of the vertical stem is pre-drilled to allow mechanical fastening 5A to a wall. The horizontal leg is turned back under itself similar to 7A and the track connection 5A is the same as previously described. The main purpose of this modification is to provide consistency and alignment for the curtain track.

Figure 7:
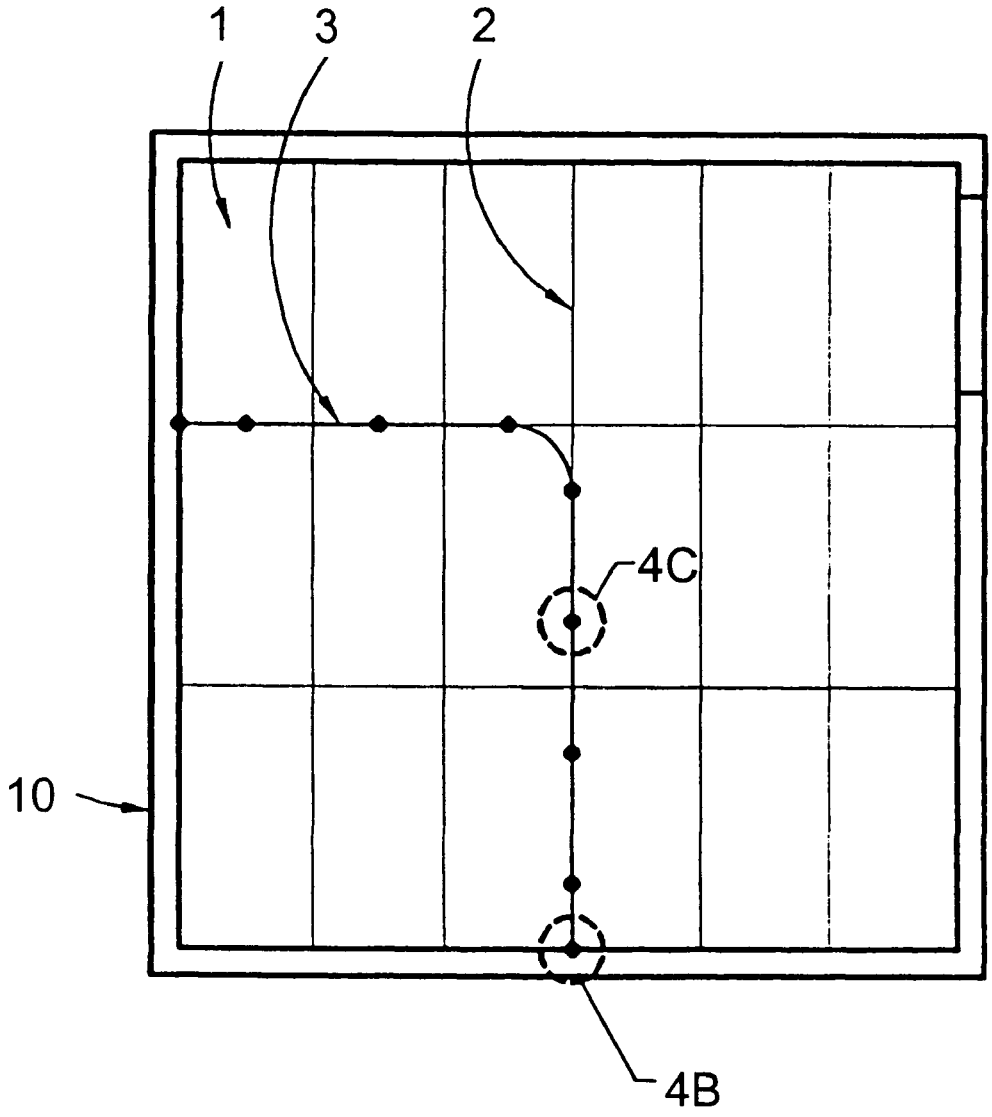
FIG. 7: Plan view of an alternate curtain track configuration in relation to ceiling grid and support clip locations.

An alternate location for mounting curtain or IV tracks is outlined in FIG. 7. This version is applicable where the track is located directly below and runs in line with the tee bar. Location 4C is cross-referenced to FIG. 8 plan detail which shows the relationship between track 3, tee bar 2 and alternate version support clip 11.

End version 4B is applicable for both standard and alternate versions. Where the track terminates at a wall, sections 9—9 and 10—10 are cut to show the configuration and placement of support clip alternate version 11 in relation to the tee bar and track.

Figure 8:
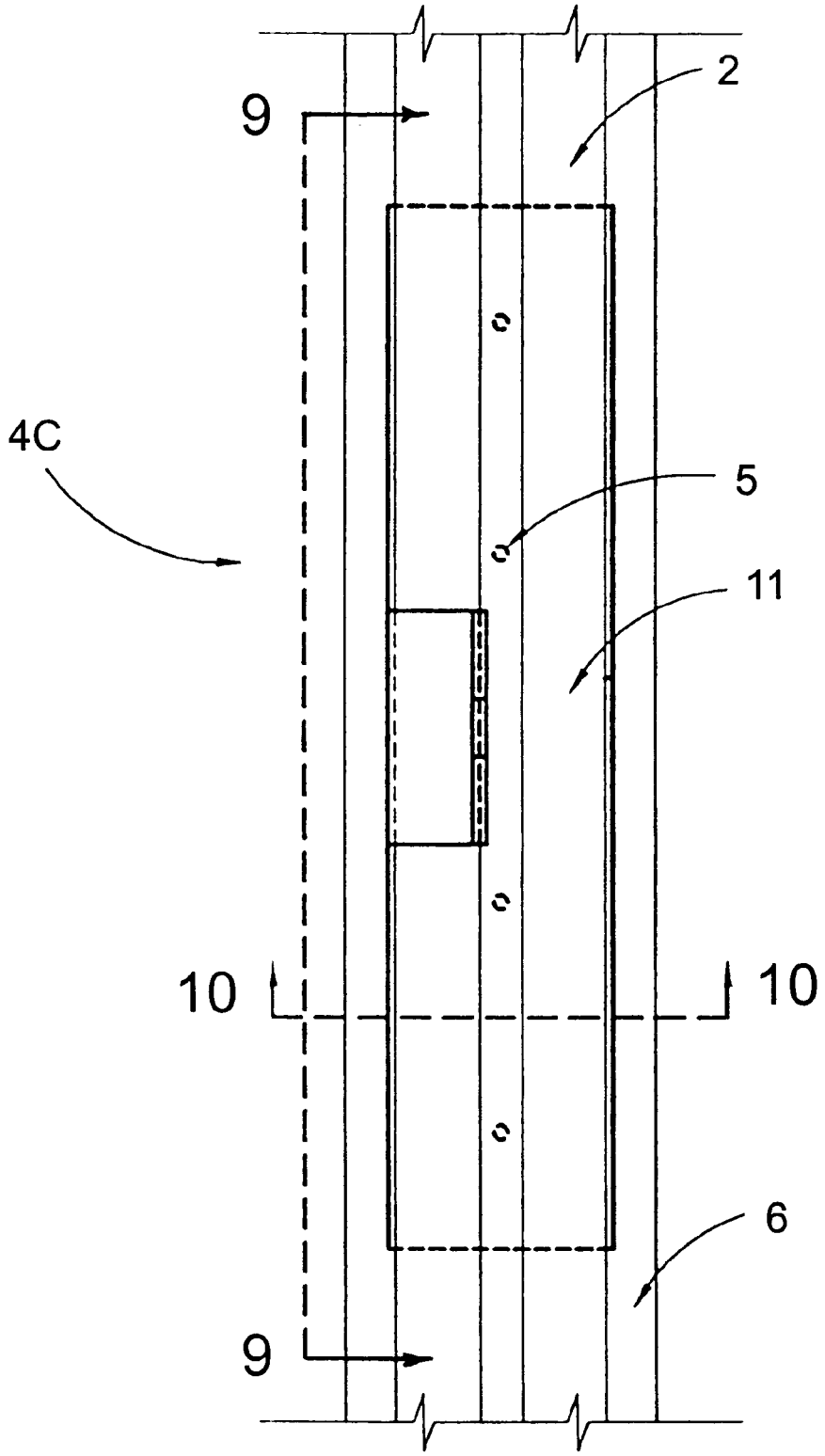
FIG. 8: Enlarged plan view of the alternate version support clip shown in relation to the tee bar and curtain or IV track.
Figure 9:
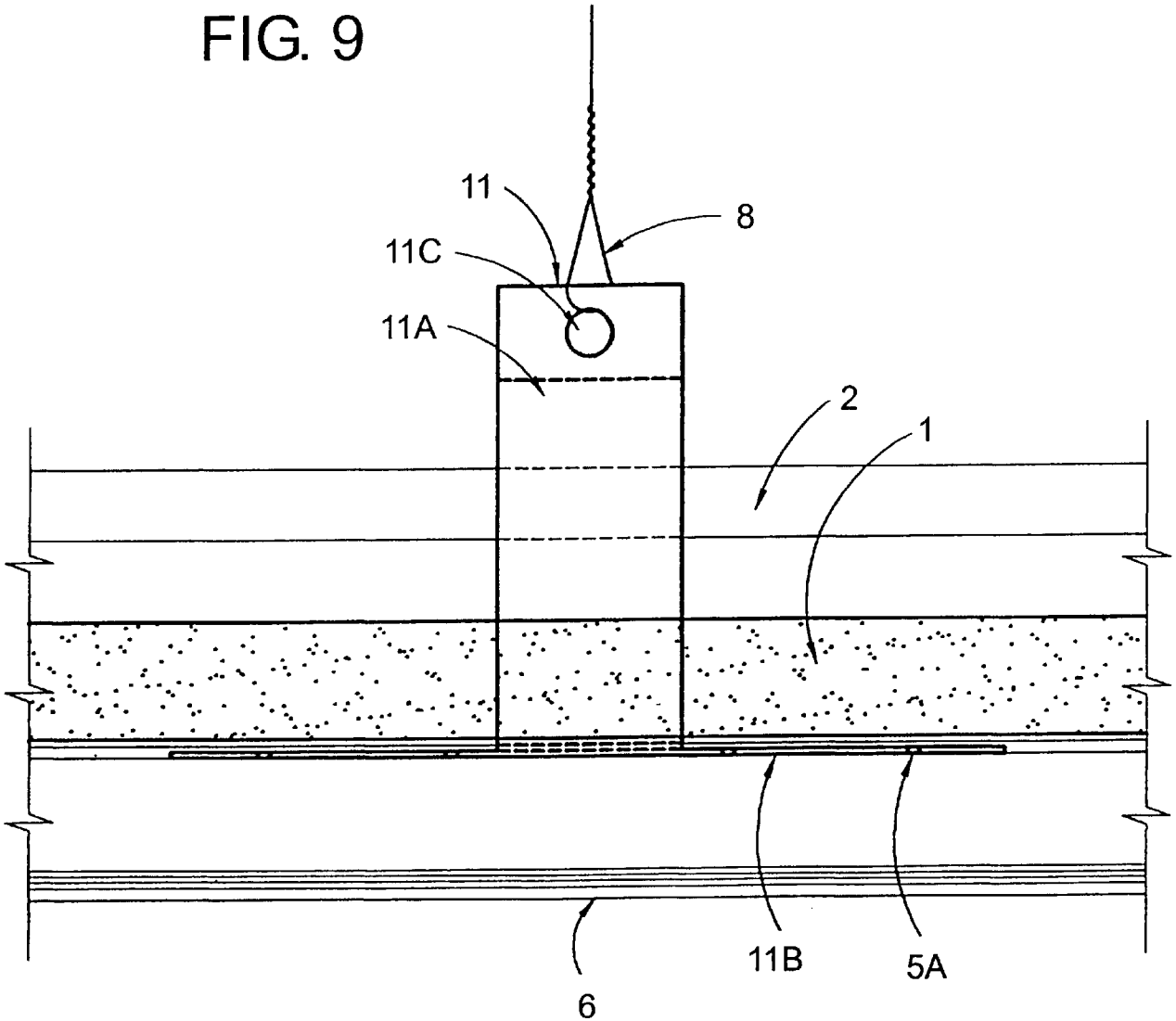
FIG. 9: Section cut through the ceiling system showing the connection of the alternate version support clip to the curtain or IV track as well as its relation to the tee bar, hanger wire and ceiling tiles.
Figure 10:
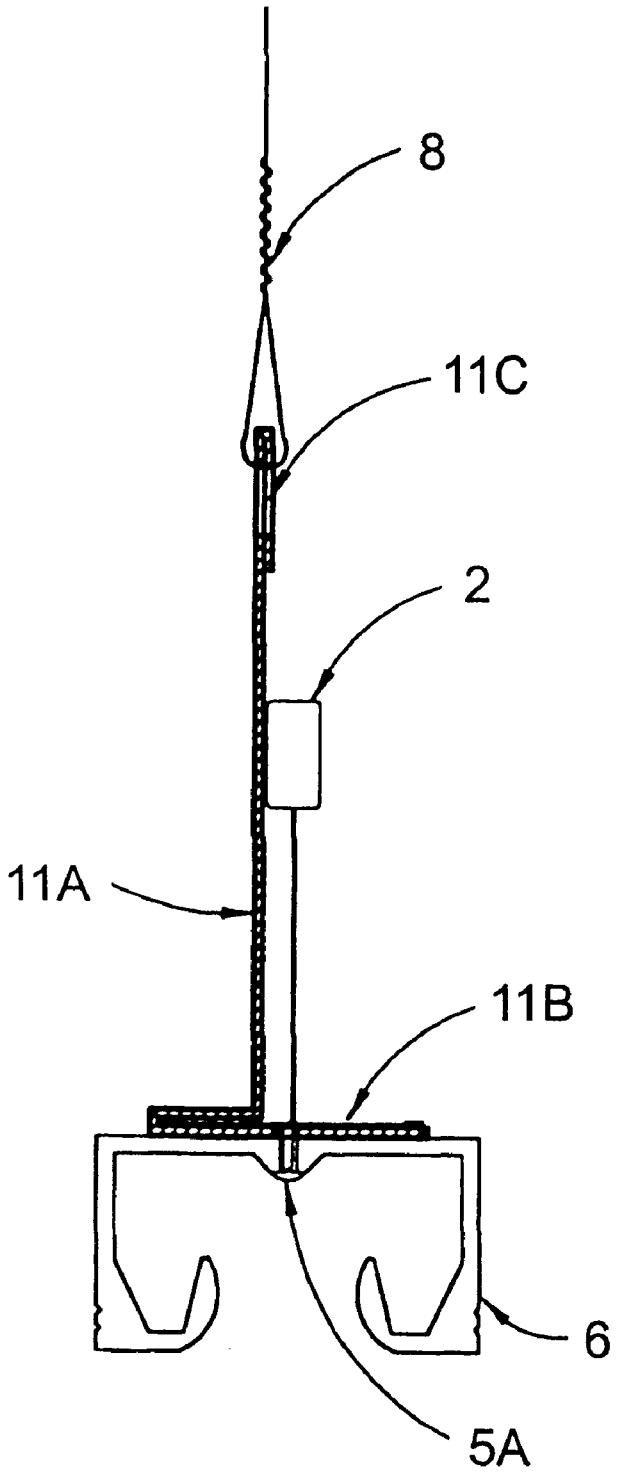
FIG. 10: Section cut through the ceiling system showing the connection of the alternate version support clip to the curtain or IV track as well as its relation to the tee bar, hanger wire and ceiling tiles.
Figure 11:
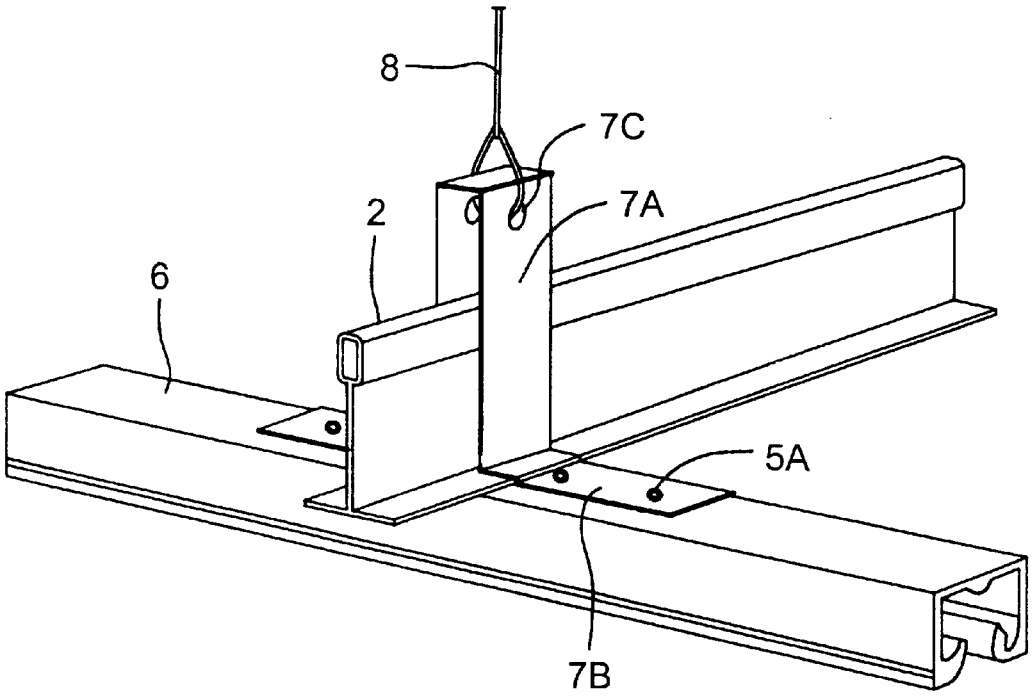
FIG. 11: Perspective view of the standard version support clip supported by a hanger wire at the top. The view also shows the clip's configuration and its location over the tee bar as well as its connection to the cubicle or IV track.
Figure 12:
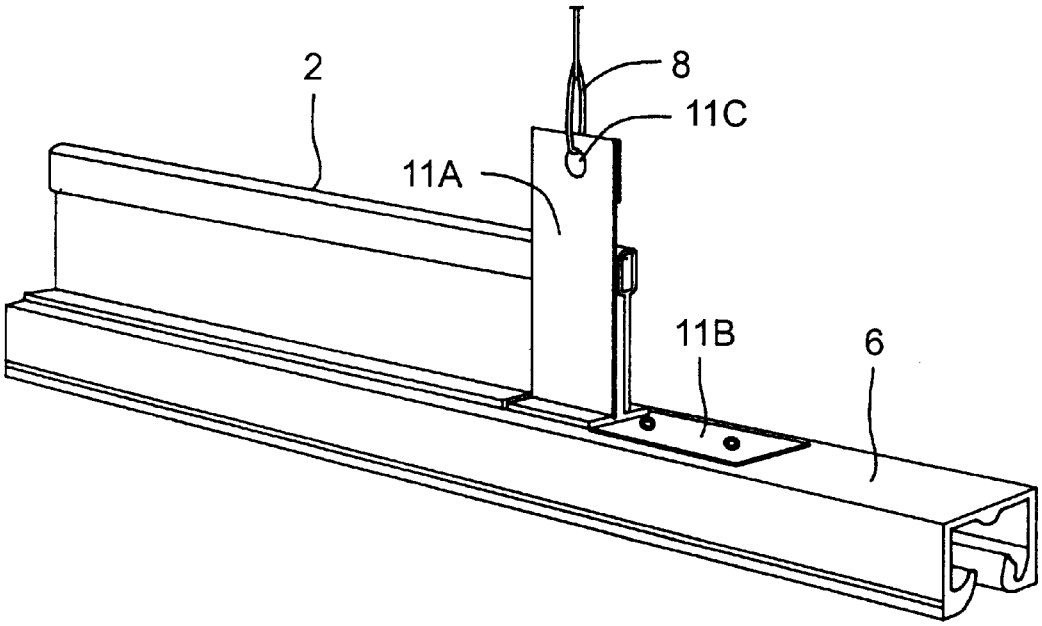
FIG. 12: Perspective view of the alternate version support clip supported by a hanger wire at the top. The view also shows the clip's configuration and its location relative to the tee bar, as well as its connection to the cubicle or IV track.

FIGS. 8–10 are an enlarged detail illustrating the alternate version support clip 11 which is also fabricated from a single piece of material. The configuration consists of a single vertical side 11A and a horizontal flange 11B. The upper end of the vertical side has a pre-drilled hole 11C to allow the hanger wire to be threaded and tied to the support clip. The lower part of the vertical side is bent 90 degrees to wrap around one side of the tee bar and transitions into the horizontal flange 11B. Track 6 is positioned with its top directly up against the underside of the support clips horizontal flange 11B. The longitudinal direction of the track runs in line with both the horizontal flange of the support clip and the tee bar. Fastening of track to clip is standard throughout all versions. FIG. 10 is a view of the same support clip alternate version 11 viewed from another angle as cross-reference to section 10—10, FIG. 6. FIGS. 11 and 12 are perspective views. All components including fastening and support devices related to the standard version modified end version and alternate version are consistent in size and method of application.

The difference between the standard version 7 and modified version 11 is that the standard version has a pair of vertical sides placed over the top of the tee bar with its horizontal flange perpendicular to the run of the tee bar whereas the modified version has one vertical side and is placed on either side or alternating sides of the tee bar with its horizontal flange parallel with the run of the tee bar.

I claim:

1. A combination, comprising:

(a) a clip suspended from a support structure consisting of two opposing horizontal flanges (7B, 11B) connected by at least one vertical support side (7A, 11A) each having a lower connecting point to which the horizontal flanges attach and an upper end;

(b) a tee bar (2) having a vertical flange and two opposing horizontal flanges; and (c) a cubicle or IV track (6), the track being attached to the horizontal flanges of the clip below the horizontal flanges of the tee bar, the clip supporting the track and being suspended from the support structure independently of the tee bar.

2. The combination of claim 1 wherein the clip has one vertical support side (11A) and the horizontal flanges of the clip extend parallel to the tee bar.

3. The combination of claim 2 wherein the vertical support side (11A) has a horizontal flange located below the horizontal flanges of the tee bar.

4. The combination of claim 3 wherein the vertical support side has an opening for receiving a hanger wire.

5. The combination of claim 1 further comprising a ceiling tile supported by the clip, the horizontal flanges of the clip being below the ceiling tile.

6. The combination of claim 1 further comprising an end support clip for connecting the track to a support, consisting of a vertical stem (9) and a horizontal flange (9A), the track being attached to the horizontal flange of the end support clip.

7. A combination, comprising:

(a) a suspended clip consisting of two opposing horizontal flanges (7B, 11B) connected by at least one vertical support side (7A, 11A) each having a lower connecting point to which the horizontal flanges attach and an upper end;

(b) a tee bar (2) having a vertical flange and two opposing horizontal flanges; and (c) a cubicle or IV track (6), the track being attached to the horizontal flanges of the clip be low the horizontal flanges of the tee bar, the clip supporting the track and being adapted to receive no support from the tee bar.

8. A combination, comprising:

(a) a clip suspended from a support structure consisting of two opposing horizontal flanges (7B, 11B) connected by at least one vertical support side (7A, 11A) each having a lower connecting point to which the horizontal flanges attach and an upper end;

(b) a tee bar (2) having a vertical flange and two opposing horizontal flanges; and (c) a cubicle or IV track (6), the track being attached to the horizontal flanges of the clip below the horizontal flanges of the tee bar, the clip supporting the track and being suspended from the support structure independently of the tee bar, and wherein the clip has two vertical support sides (7A) and a horizontal spacer connected to the upper end of each vertical support side and the horizontal flanges of the clip extend perpendicular to the tee bar.

9. The combination of claim 8 wherein the two vertical support sides (7A) each have a horizontal flange which serves as the lower connecting point to which the horizontal flanges (7*b*) attach.

10. The combination of claim 9 wherein the two vertical support sides (7A) each have an opening for receiving hanger wire.

* * * * *